US006369518B1

(12) United States Patent
Kelly et al.

(10) Patent No.: US 6,369,518 B1
(45) Date of Patent: Apr. 9, 2002

(54) LAMPS WITH ELECTRONIC CONTROL OF COLOR TEMPERATURE AND COLOR RENDERING INDEX

(75) Inventors: Timothy L. Kelly, Boston; Huiling Zhu, Lexington; Jakob Maya, Brookline, all of MA (US)

(73) Assignee: Matsoshita Electric Works R & D Laboratories Inc

( * ) Notice: Subject to any disclaimer, the term of this patent is extended or adjusted under 35 U.S.C. 154(b) by 0 days.

(21) Appl. No.: 09/239,712

(22) Filed: Jan. 28, 1999

(51) Int. Cl.[7] ..... H05B 37/02
(52) U.S. Cl. ..... 315/209 R; 362/263
(58) Field of Search ..... 315/209 R, 291, 315/182, 246, 307; 362/261, 262, 263, 265; H05B 37/02

(56) References Cited

U.S. PATENT DOCUMENTS

| | | | | | |
|---|---|---|---|---|---|
| 4,064,418 | A | * | 12/1977 | Kearney | 315/348 |
| 4,143,301 | A | * | 3/1979 | Strauss et al. | 315/73 |
| 4,360,758 | A | * | 11/1982 | Thornton, Jr. et al. | 313/227 |
| 4,937,501 | A | * | 6/1990 | Ganser et al. | 315/209 R |
| 5,569,984 | A | * | 10/1996 | Holtslag | 315/307 |
| 5,572,093 | A | * | 11/1996 | Kiefer | 315/289 |
| 6,034,489 | A | * | 3/2000 | Weng | 315/307 |
| 6,144,172 | A | * | 11/2000 | Sun | 315/291 |
| 6,175,199 | B1 | * | 1/2001 | Moskowitz | 315/291 |

OTHER PUBLICATIONS

H. Nishimura et al., "A New Electronic Ballast for HID Lamps," Summer 1988, Journal of IES, p. 70.

J. H. Campbell, "Initial Characteristics of High–Frequency Discharge Lamps on High–Frequency Power," Dec. 1969, Journal of IES, p. 713.

H. Faehnrich et al., "Electronic Ballasts for Metal Halide Lamps," Summer 1988, Journal of IES, p. 131.

J. W. Denneman, "Acoustic Resonances in High Frequency Operated Low Wattage Metal Halide Lamps," vol. 38 Nos. 4/5, Philips Journal of Research, p. 263 (1983).

J. Ribas et al., "Design Considerations for Optimum Ignition and Dimming of Fluorescent Lamps Using a Resonant Inverter Operating Open Loop," vol. 3, Proceedings of IEEE/IAS Conference, St. Louis, Missouri, p. 2068 (1998) (see also references therein).

K. Hilpert et al., "Enhancement of Rare Earth Metals by Chemical Vapour Transport in Metal Halide Lamps," Paper K08, Proceedings of the 8th International Symposium on the Science and Technology of Light Sources, Greifswald, Germany (1998).

* cited by examiner

*Primary Examiner*—Don Wong
*Assistant Examiner*—Trinh Do Dinh

(57) ABSTRACT

A method and system of modifying one feature of a high-pressure lamp without significantly affecting the other features, the features including the luminosity, the color rendering index, the color temperature, or the deviation from the black body locus ($D_{UV}$). An arc discharge is initiated within the arc tube with a ballast imposing an alternating current waveform on the electrodes. In this way, the electrodes change from positive to negative in each cycle of operation. The waveform of each cycle is modified through the ballast to energize one electrode as positive or negative for a longer time than the other electrode, thereby altering the temperature distribution within the arc tube by changing the cold spot and hot spot temperatures in a lamp which has modifiable emission features.

16 Claims, 6 Drawing Sheets

LAMPS WITH ELECTRONIC CONTROL OF COLOR TEMPERATURE AND COLOR RENDERING INDEX

BACKGROUND OF THE INVENTION

The present invention relates to high-intensity discharge lamps and, more particularly, to metal halide lamps. With such lamps, light is emitted primarily from vaporized metal atoms excited by electron collisions in the arc discharge path. The metal atoms are introduced into the lamp in the form of metal halides. They are vaporized after starting by the hot arc discharge plasma which typically comprise ionized rare gases and mercury. The metal halides have much higher vapor pressures than elemental metals and, therefore, produce a far greater concentration of metal excited states in the discharge arc, which greatly enhances radiation output. Using metal halides, a wide variety of metal atoms can be introduced into a lamp, each with unique emissions which can be combined to create desired spectra. In this manner, lamps of high efficacy can be made which emit visible light sufficiently white to be pleasing to the human eye and useful for general illumination purposes. Lamps emitting nonvisible ultraviolet radiation can also be made for special applications, such as semiconductor processing or germicidal irradiation. The color of a visible light source is typically described in terms of Correlated Color Temperature (CCT), Color Rendering Index (CRI), and Chromaticity (expressed in x & y coordinates).

In designing a metal halide lamp, a combination of metal halides is chosen to achieve a desired color at a designated power. Deviations from the designated rated power typically result in changes in color. In particular, reducing power usually results in a color which is less "white" than desired. The present invention provides a method of adjusting the color of a metal halide lamp by enhancing the radiation of specific metal atoms. In one embodiment, the invention can be used to maintain a constant color temperature (CCT) during dimming.

This invention most conveniently can be realized by the utilization of an electronic ballast as described in "A New Electronic Ballast for HID Lamps", Nishimura et al., Journal of IES, Summer 1998, Page 70; and "High Frequency Discharge Lamps on High Frequency Power", J. H. Campbell, Journal of IES, Dec. 1969, Page 713. In this particular ballast, the waveform is typically a square wave of relatively low frequency. The low-frequency operation, that is, between 50 and 400 Hz, has been shown to be very successful, and these ballasts are widely available in the marketplace. Examples of such ballasts are made by Aromat Corp. (NAIS brand), WPI Corp. and Phillips. We have combined the operation of such an electronic ballast with the metal halide lamp so we are able to improve some of the characteristics of the light source which will be described further herein.

As mentioned heretofore, experiments have indicated that there are few practical ways of changing the color temperature of a metal halide lamp at rated power. We have found that under dimming conditions, the CCT and the hue change involuntarily, and in an undesirable manner. If the same CCT level and illumination are maintained, changing the CCT in a controlled manner cannot be accomplished with existing metal halide lamps and normal ballasting conditions. Most ballasts used today are magnetic ballasts and there is no controlled way of changing the CCT at rated power.

Lamp-to-lamp variations in CCT are an annoying characteristic of currently available metal halide lamps. Due to manufacturing process tolerances, the fills and arc tube geometry of lamps are not exactly the same from lamp to lamp. This results in lamp-to-lamp color variation of as much as ±400° K. in quartz lamps and ±200° K. in ceramic metal halide lamps. This slight appearance difference from lamp to lamp is perceptible and annoying, especially when lamps are next to each other in a typical ceiling/downlight application. This color temperature variation can be perceived especially in color-sensitive applications, such as illumination used for fabric, fresh produce or art, for example.

A further problem occurs even if lamps are made identically and they all have the same color hue at 100 hr. Due to different aging circumstances, the color/hue tends to change somewhat differently in each lamp. This is perceptible to the eye after lamps have burned about 2000–4000 hrs. The concept of altering the duty cycle in lamps has been investigated in fluorescent lamps primarily for reducing the power into the lamp (i.e., dimming) ("Design Considerations for Optimum Ignition and Dimming of Fluorescent Lamps Using a Resonant Inverter Operating Open Loop", Ribas et al., Proceedings of IEEE/IAS Conference, 1998, Page 2068, Vol. 3.) In all cases, however, the waveform is symmetric, and in many cases sinusoidal.

Therefore, an object of the present invention is to provide a light source where at rated power the color can be varied depending on the application either for mood control or for special effects, such as museums or color-sensitive merchandise to accentuate certain colors. The ability to change the color at will and in a controlled manner is a highly desirable feature.

Another object of the present invention is to ameliorate the problem of lamp-to-lamp color variation in metal halide lamps, especially in low wattage metal halide lamps, both initially and throughout the life of the lamp.

Another object of the present invention is to ameliorate the problem of lamp color change over its life. Typically, lamps can have a particular color temperature, but after burning several thousand hours they tend to change colors, as mentioned above.

A further object of the present invention is to be able to burn the lamps and make sure that the color does not change during dimming. Often times, primarily for energy saving purposes, dimming is highly desirable. However, the color changes substantially during dimming in an uncontrolled and undesirable manner. Thus, it is highly desirable to maintain the design point color temperature of the lamps during dimming.

Another object of the present invention is to provide a metal halide lamp that has a CRI that does not deteriorate during life and is substantially the same from lamp to lamp.

DESCRIPTION OF FIGURES

FIG. 6 is a schematic circuit diagram which provides a variable duty cycle.

SUMMARY OF INVENTION

The present invention relates to a method and a system for modifying the color of a high-pressure lamp using an arc tube containing a fill of mercury, rare gas and ionizable metal halides. According to the invention, an arc discharge is initiated within the arc tube. A ballast that can have its duty cycle changed at will is used to power the arc tube. The ballast imposes an alternating current waveform on the electrodes, whereby the electrodes change from positive to negtive in each cycle of operation. By changing the duty cycle, the waveform of each cycle is modified to energize one electrode as positive or negative for a longer time than the other electrode, thereby altering the temperature distribution within the arc tube, whereby to change the cold spot and hot spot temperature in the arc tube to result in a color-variable metal halide discharge lamp.

DESCRIPTION OF THE PREFERRED EMBODIMENTS

Figure 1:
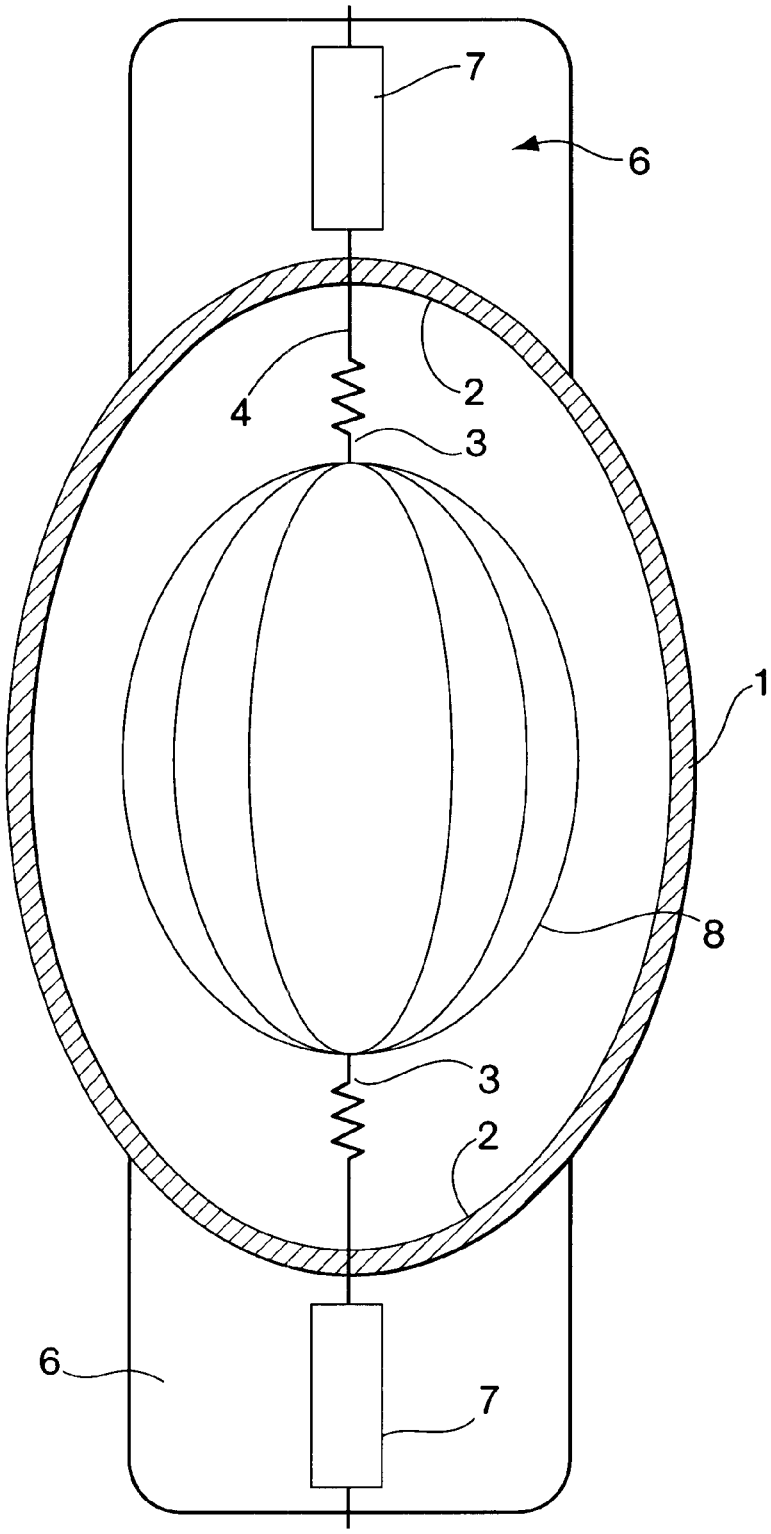
FIG. 1 is an elevational view in cross section of a typical quartz arc tube ordinarily used in low wattage metal halide lamps.

Referring to FIG. 1, an arc tube 1 containing metal halides can be made out of quartz or polycrystalline-alumina (PCA). With both materials, the temperature distribution in the arc tubes is critical for the proper operation of the discharge between electrodes 3. The vapor pressure of the salts and, therefore, the metal atom radiators in the gas phase are primarily determined by the cold spot temperature. Since the metal halide lamps contain a variety of metal halide salts, the metallic salt composition and the cold spot temperature essentially determine the color that is emitted by the lamp. The arc tube 1 includes press seals 6 having a molybdenum foil section 7 connecting the electrodes 3 to a ballast and a power supply.

A slight variation in the cold spot temperature affects the total salt vapor pressure which, in turn, affects the number of radiators in the gas phase and, therefore, the color. However, for a given power and a given shaped arc tube (which is determined by manufacturing), the cold spot temperature is fixed. Therefore, the color is presumably fixed. In order to change the color on demand, the thermal balance of the arc tube must be changed while maintaining constant power that goes into the arc tube.

Under normal circumstances, a lamp is operated by a magnetic ballast, as mentioned above. Magnetic ballasts are bulky, large, and not convenient for rendering to practice our invention. Therefore, we have conveniently chosen an electronic ballast to operate the lamp.

An important parameter in the design of the arc tube is the hottest point in the arc tube or hot spot. The hot spot is usually somewhere between the anode and the cathode of the arc tube near the center of the tube. Depending on the arc tube shape and depending on the construction that may change somewhat, the hot spot is usually away from the ends for a vertically burning lamp. For a horizontal operation, the hot spot usually tends to be at the top since the arc 8 tends to bulge toward the top, which heats the upper part of the arc tube. In horizontal burning, the cold spot is at the bottom of the arc tube. The reason the hot spot, which is the hottest point of the arc tube, is important is that chemical reactions are accelerated at the high temperature. Therefore, if the temperature at the hot spot is very high, the chemical reactions with the walls are accelerated leading to devitrification in quartz or etching away in PCA, and can result in the arc tube prematurely leaking and catastrophic failure. Therefore, we have found one has to maintain a hot spot temperature no greater than about 900–950° C. in quartz envelopes and no greater than 1100–1200° C. in PCA. On the other hand, in order to maintain enough vapor pressure in the gas phase so that the lamp will operate as efficiently as it can, the cold spot has to be somewhere around 750–850° C. Thus, there is a relatively small margin of operation between the hot and cold spots. Past experiences as well as publications have shown that the closer the temperatures between the hot spot and the cold spot are, and the more uniform the temperature distribution is within the arc tube, the more efficiently the entire arc tube operates and the longer the life of the lamp.

Therefore, by taking an AC lamp and running it closer to a DC mode (but not quite a DC mode) the temperature distribution of the arc tube and the cold spot temperature can be affected.

Figure 2:
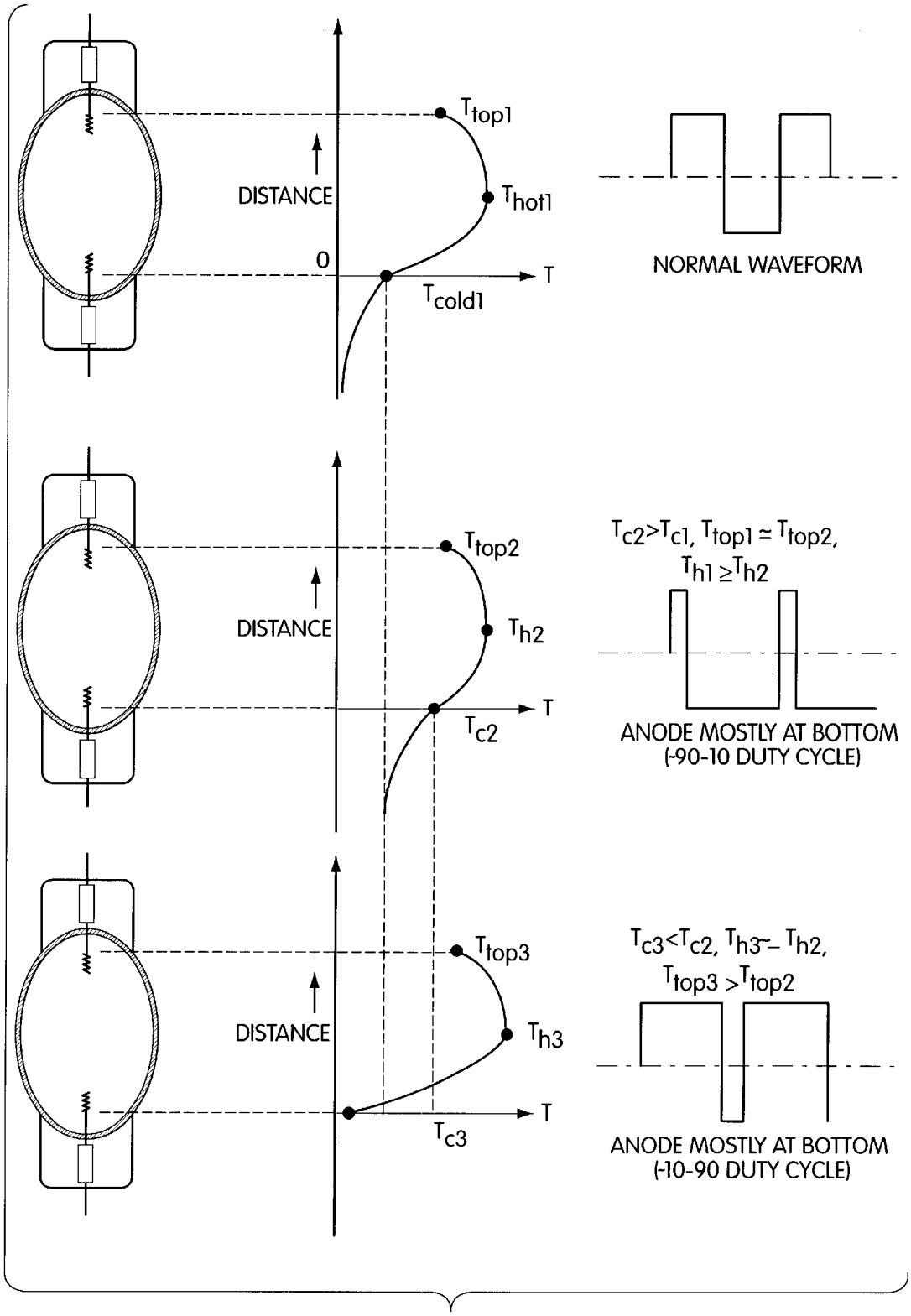
FIG. 2 are curves illustrating temperature profiles (schematically only) for an arc tube as a function of the different duty cycles of an applied waveform. Attention is directed to the relative values of $T_{cold}$ ($T_c$), $T_{hot}$ ($T_h$) and $T_{top}$ for the different duty cycles illustrated in the Figure.

As mentioned above, by taking a square wave output ballast and running it as intended for an AC operation, an exactly symmetrical waveform is produced. Such operation can be called 50-50, that is, the electrodes spending 50% of the time as an anode and 50% as a cathode. In running the lamp, we have the normal operation and the normal temperature distribution of the arc tube, as shown in FIG. 2. We have found if we change the square wave duty cycle so the electrodes are not operating in anode and cathode mode each 50% of the time, but rather, for example, the bottom electrode is operating 90% of the time as an anode and 10% of the time as a cathode, the bottom end well gets hotter and the cold spot temperature is somewhat increased. The hot spot or top electrode temperatures are not substantially affected.

Alternatively, if one changes the ratio whereby say 90% of the time the top electrode is in anode mode and the bottom electrode is in cathode mode, the cold spot is cooler and the top electrode area is hotter so there is a different temperature distribution, which again affects the color, efficiency, and performance of the lamp. Thus, we have found by adjusting the duty cycle we can change on demand the color, CRI, efficacy, and, in many cases, the hue of the lamp in a very controllable manner for a variety of arc tube shapes for both PCA and quartz arc tubes.

FIG. 6 is a schematic for a ballast used to provide a variable duty cycle operation. 120V AC input power is fed into an EMI filtering and power correction circuit, then into a DC buck converter which performs the ballasting function. The output of the buck convertor is then fed back into a full bridge switching circuit. A variable duty cycle waveform generator produces two variable duty cycle wave outputs A and B whose duty cycle is set between 10% and 90% by the potentiometer VR, Outputs A and B are fed into the hi-side driver circuits U1 and U2. The hi-side drivers alternately switch their respective upper and lower transistors in step with their inputs such that Q1 and Q4 are switched on for one half cycle and Q2 and Q3 are switched on for the other half cycle. Both hi-side driver circuits and the variable duty cycle waveform generator incorporate a small amount od dead time (both circuits low) in order to eliminate cross conduction of the transistors.

Another parameter that may be changing in the arc tube, due to the shifting duty cycle, is the ion density distribution. Since ions are attracted by cathodes, if one of the electrodes spends more than 50% of the time being anodic (+), the ion density in the vicinity of that electrode will be higher than it is in normal operation (50-50). This could lead to what is called species segregation where the low ionization potential metal tends to accumulate. Since, due to convection and other effects, there is some species segregation in metal halide lamps operating in a normal duty cycle (50-50), the variable duty cycle effect could be used either to augment or reduce the species segregation, depending on the circumstances.

Therefore, a key point of this invention is the ability to control the performance of the lamp by altering the duty cycle of an AC waveform.

One of the important considerations in changing the duty cycle is that these lamps are designed for AC operation where each electrode spends half its time as anode and half its time as cathode. However, when the duty cycle is changed, for example, a 90-10 duty cycle with the bottom electrode mostly as anode and 10% of the time as cathode, the operation of the lamp amounts to one of an AC lamp running mostly in the DC mode. Of course, a 60-40 duty cycle is substantially still running as an AC lamp, since this duty cycle is very close to 50-50.

Figure 3:
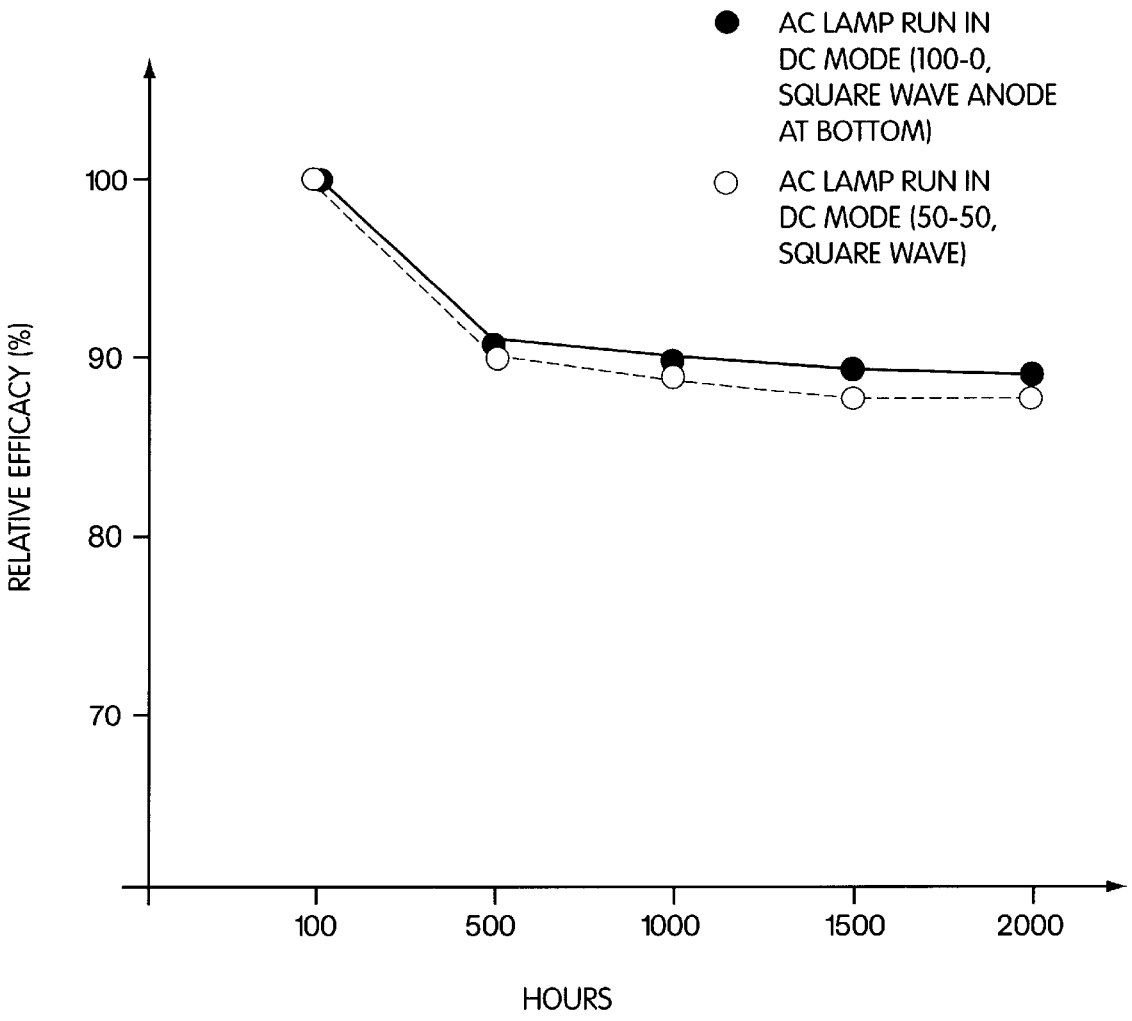
FIG. 3 is a curve illustrating data of lamp maintenance of a ceramic AC 150 W lamp run in DC mode (VBU) (that is, 100%–0% duty cycle where the bottom electrode was anode), and compared with lamp maintenance when the lamp is run in normal AC mode.

Since the lamp has not been optimized for DC operation, but rather for the AC operation, the life and maintenance should be considered. Maintenance experiments were run with AC ceramic lamps. The tests were run in the DC mode which amounts to 100% the bottom electrode being anode and the top electrode being a cathode, an extreme case. No significant deterioration of the performance was observed. This was an encouraging result and is shown in FIG. 3.

Figure 4A:
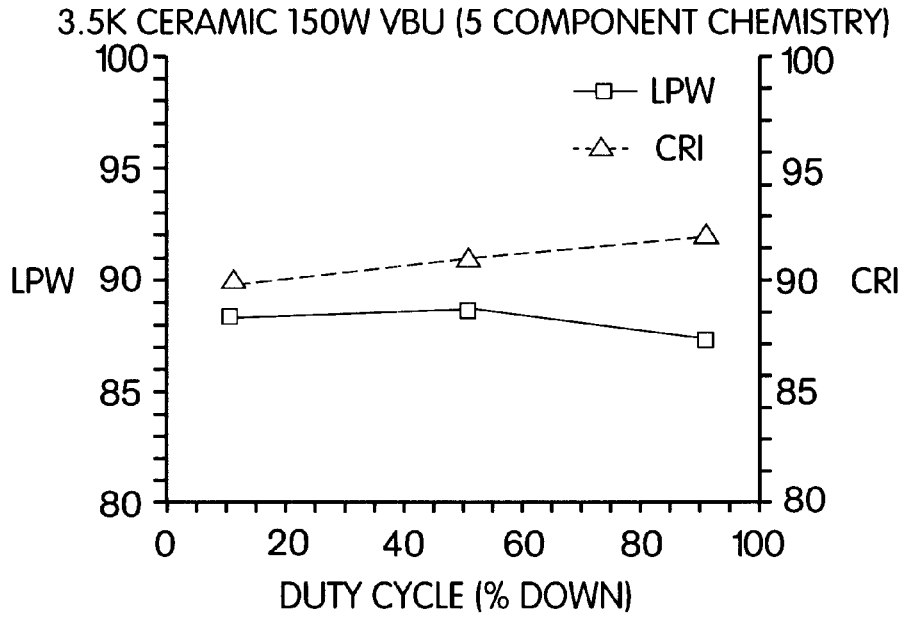
FIGS. 4*a, b, c* and *d* are curves illustrating performance data (CRI, CCT, relative$_{LPW}$, and $D_{UV}$) as function of duty cycle for quartz (4*c,d*) and PCA (4*a,b*) arc tubes. The data were taken with commercially available 150 W lamps of several manufacturers for lamps burning vertically base up.
Figure 4B:
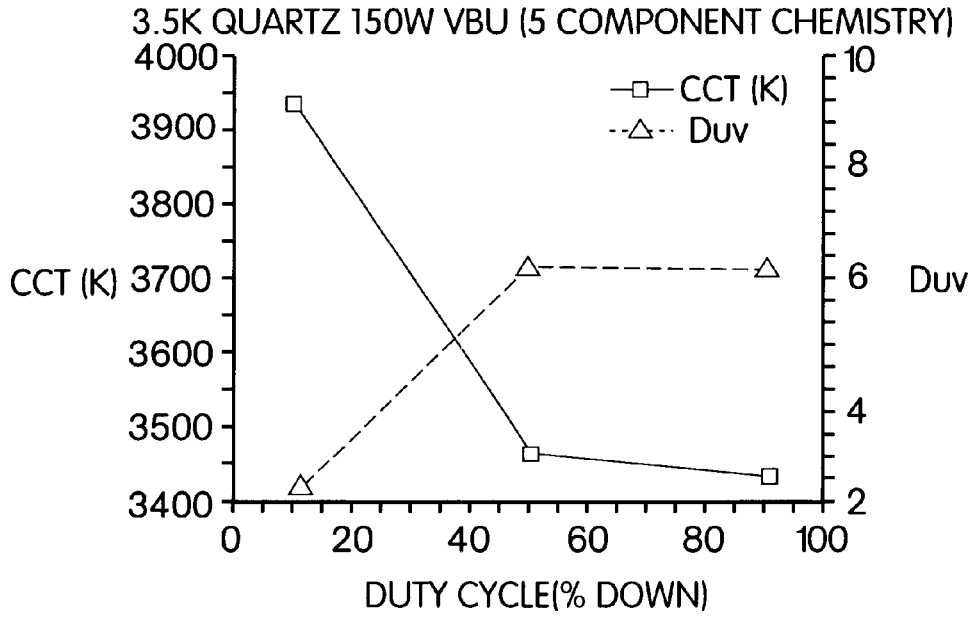
Figure 4C:
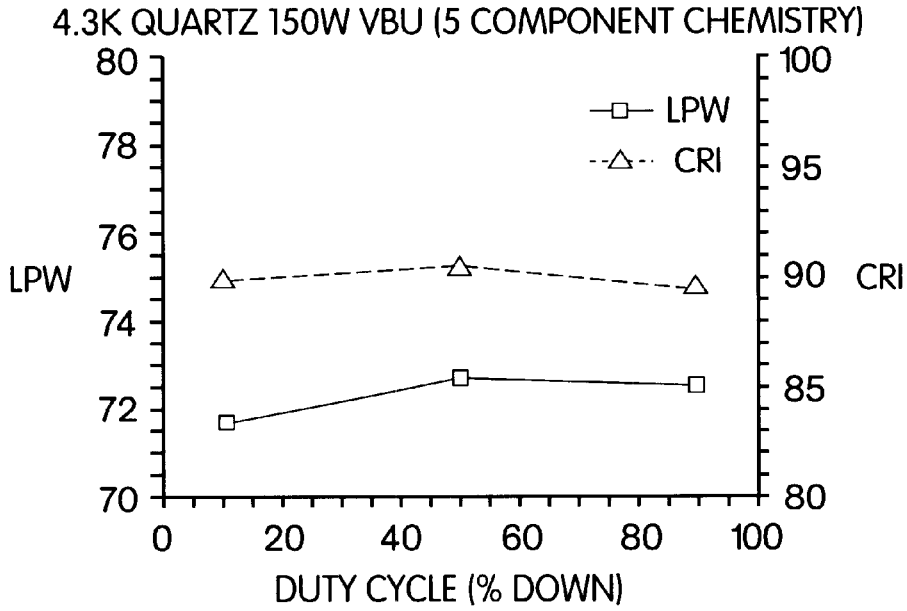
Figure 4D:
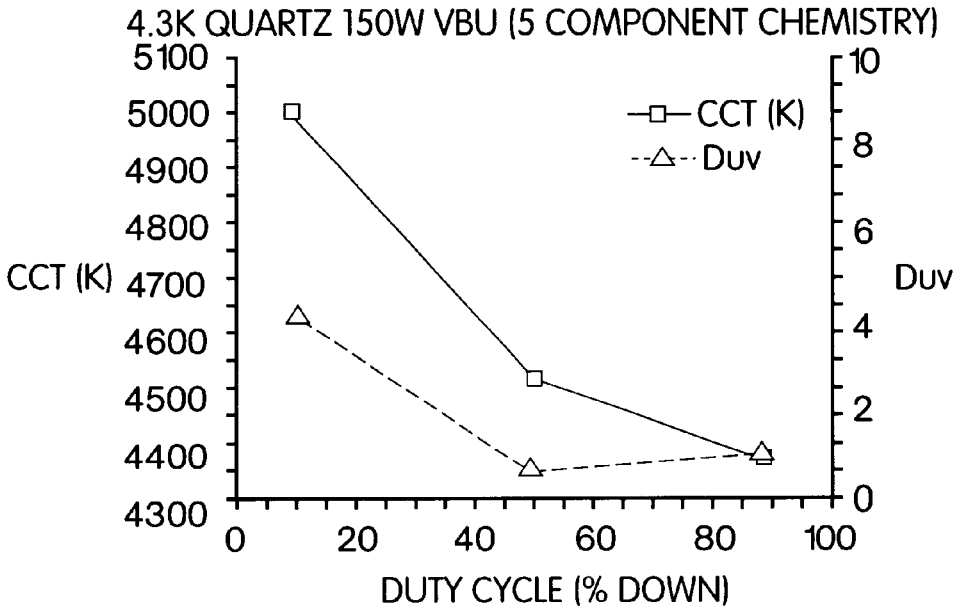

In FIGS. 4*a* and 4*b* we show the performance characteristics of a quartz and a PCA arc tube (150 W) run at 50-50 duty cycle which is basically electrodes burning half the time as anode and half the time as cathode, and then a 90-10 duty cycle where the bottom electrode is the anode mostly and 10-90 where the top electrode is the anode mostly. Here the data is for CRI, CCT, as well as LPW and $D_{UV}$ variations.

As is well known, $D_{UV}$ gives a measure of the deviation from black body locus, that is the hue. As is also well known, the larger the $D_{UV}$ the more objectionable the color of the light source becomes. Therefore, we wanted to track how the $D_{UV}$ of the lamp was changing on the different duty cycles. As can be seen from the FIGS. 4*a* and 4*b,* there is a substantial amount of color temperature variation that can be brought about by simply varying the duty cycle away from 50-50 to either 10-90 or 90-10 for vertical base up operation. This certainly is an important control feature to vary the color temperature in a controlled manner, while the CRI, LPW and $D_{UV}$ are not substantially or adversely affected.

The color change that can be brought about by varying the duty cycle is larger than the typical color variation during the life of the lamp. This is a very encouraging and possible way of maintaining the color temperature constant with a control system. For example, if 4000° K. color temperature is desired, and over the life the color changes to about 4500° K., it is possible to bring it down to 4000° K. by varying the duty cycle of the driver. In other words, the color variation that can be brought about by changing the duty cycle is larger than the color variation during the life of the lamp. Therefore, the present invention provides a tool to maintain the color constant during the life of the lamp. Furthermore, since lamp-to-lamp color variations are within ±400° K. in quartz and ±200° K. in PCA arc tubes, lamp-to-lamp color variations in new installations can be quickly eliminated by adjusting the duty cycle of each of the drivers slightly. That could be done automatically by simply sensing the color with a photo diode system.

It is well known that metal halide lamps sometimes exhibit a phenomenon called species segregation. This leads to color separation because different species emit in different parts of the spectrum ("Electric Discharge Lamps", J. F. Waymouth, MIT Press, 1971). We have found that by altering the duty cycle this phenomenon can be ameliorated because when the thermal balance of the arc tube is changed, the change opposes the segregation and minimizes the effect. For example, by running the anode 90% at the bottom we increase the temperature of the cold spot, thereby increasing the salt content in the gas phase and breakdown the color separation that is inherent in certain special design arc tube shapes and chemistries. In addition to this, segregation may be reduced due to cataphoretic effects resulting from running the lamp in a partial DC mode.

Figure 5A:
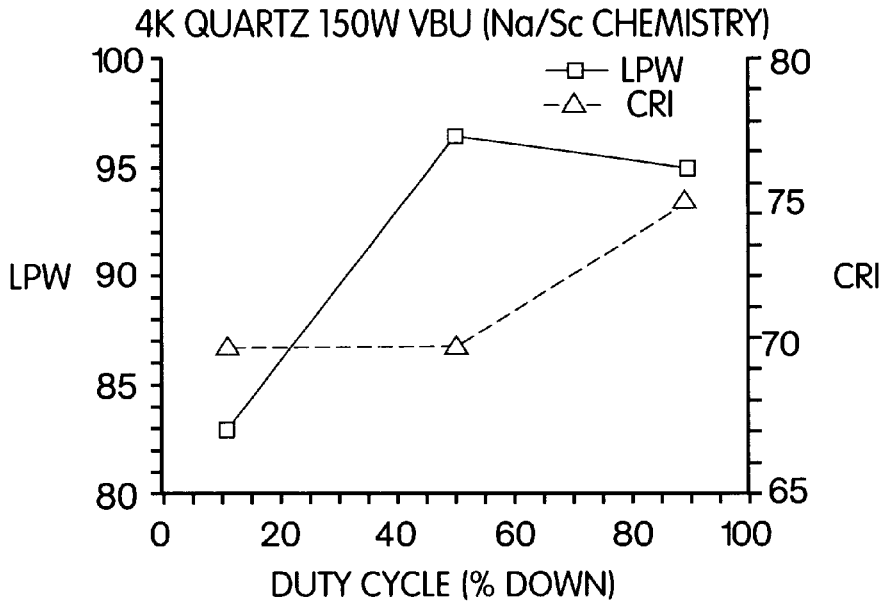
FIGS. 5*a* and 5*b* are curves illustrating the performance data of a different chemistry lamp, whereby the hue of the lamp is changed by altering the duty cycle.
Figure 5B:
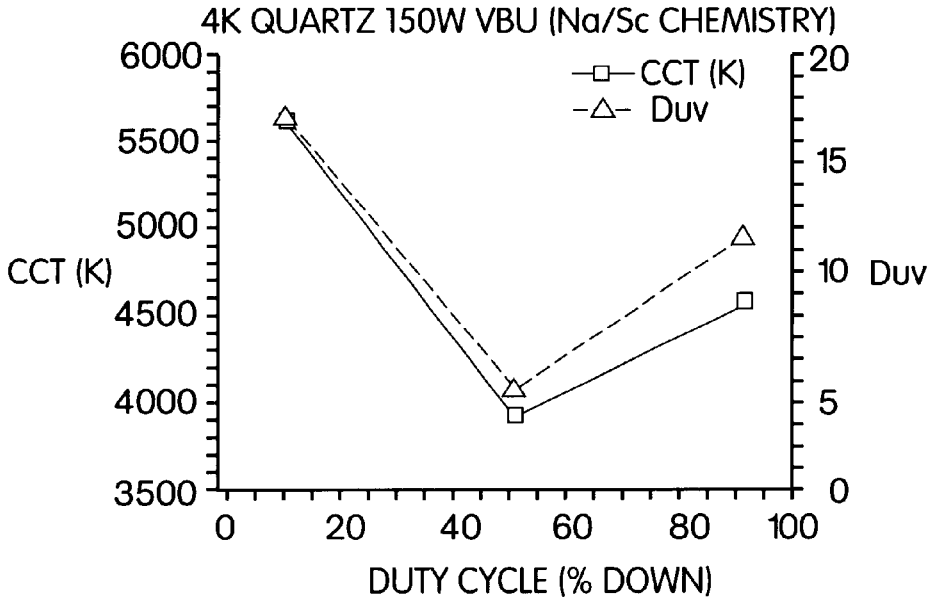

It is worth noting that in some cases it is desirable to change the hue of the lamp for mood control, entertainment, stage lighting, etc. This means that it would be desirable to shift away from being on the black body curve (complete white) and give the light source a hint of purple or red or green, etc. As can be seen from FIG. 5*a* and *b,* it is possible to bring this about with lamps of certain chemistries. Here, a definition of a color hue is an increase of the $D_{UV}$ to values greater than 5. In such cases, by shifting the duty cycle we can move from a $D_{UV}<5$ (complete white) to $D_{UV}>5$ (e.g., 10 or 15), where the hue is not anymore white. The data of FIGS. 5*a* and 5*b* was generated with a commercial quartz metal halide lamp containing Na/Sc chemistry.

Accentuated hue lighting often finds applications in merchandise illumination where one particular color needs to be highlighted at particular times, while the rest of the time a complete white color is desired. A further application could be seasonal. For example, a warmer reddish hue could be desirable during winter while a more bluish "cool" hue may be desirable during summer. The present invention allows one to bring about such desirable features simply with a shift of a dial.

It is apparent that changes and modifications can be made within the spirit and scope of the present invention, but it is our intention, however, to only be limited by the spirit and scope of the following claims.

As our invention we claim:

1. A lighting system comprising:

a high-pressure lamp having an arc tube with electrodes at each end and containing a fill of mercury, rare gas and metal halides; and a ballast including a means in said ballast for modifying the waveform of each cycle from sinusoidal to another shape; and electric connection means between said lamp and said ballast whereby modifying the waveform of each cycle will energize one electrode as positive or negative for a longer time than the other electrode thereby altering the temperature distribution within said arc tube whereby to change the cold spot and hot spot temperature in said arc tube to result in a high-pressure metal halide discharge lamp with variable features of luminosity, the color rendering index, color temperature or deviation from the black body locus ($D_{UV}$).

2. A method of modifying one feature of a high-pressure lamp without significantly affecting the other features, the features including the luminosity, the color rendering index, the color temperature or the deviation from the black body locus ($D_{UV}$), said lamp having an arc tube with electrodes at each end and containing a fill of mercury, rare gas and metal halides, said method comprising:

initiating an arc discharge within said arc tube with a ballast imposing an alternating current waveform on said electrodes whereby the electrodes change from positive to negative in each cycle of operation;

modifying the waveform of each cycle to energize one electrode as positive or negative for a longer time than the other electrode thereby altering the temperature distribution within said arc tube by changing the cold spot and hot spot temperatures in said arc tube to result in a lamp which can have a change in the output spectrum and the feature of luminosity, color rendering index, color temperature or deviation from the black body locus ($D_{UV}$).

3. The method according to claim 1 wherein the wave form for each duty cycle is square.

4. The method according to claim 1 wherein the lamp operates substantially in a direct current mode.

5. A method of modifying the luminosity of a high-pressure lamp having an arc tube with electrodes at each end and containing a fill of mercury, rare gas and metal halides without modifying the color of said lamp, said method comprising:

initiating an arc discharge within said arc tube with a ballast and imposing an alternating current waveform on said electrodes whereby the electrodes change from positive to negative in each cycle of operation;

modifying the waveform of each cycle through the ballast to energize one electrode as positive or negative for a longer time than the other electrode thereby altering the temperature distribution within said arc tube as the luminosity of said lamp is modified by changing the cold spot and hot spot temperatures to result in a metal halide discharge lamp which does not appreciably change color during luminosity modification.

6. The method according to claim 5 wherein the wave form for each duty cycle is square.

7. The method according to claim 5 wherein the lamp operates substantially in a direct current mode.

8. A method of compensating for variations in color temperature of a high-pressure lamp having an arc tube with electrodes at each end and containing a fill of mercury, rare gas and metal halides without modifying the color temperature of said lamp, said method comprising:

initiating an arc discharge within said arc tube with a ballast and imposing an alternating current waveform on said electrodes whereby the electrodes change from positive to negative in each cycle of operation;

establishing a standard for the color temperature of said lamp;

sensing the color temperature of the light emission of said lamp over its life;

modifying the waveform of each cycle through the ballast in accordance with said color temperature sensing whereby to energize one electrode as positive or negative for a longer time than the other electrode thereby altering the temperature distribution within said arc tube by changing the cold spot and hot spot temperatures in said arc tube to regain said established standard.

9. The method according to claim 8 wherein the wave form for each duty cycle is square.

10. The method according to claim 8 wherein the lamp operates substantially in a direct current mode.

11. A method of changing the color rendering index of a high-pressure lamp having an arc tube with electrodes at each end and containing a fill of mercury, rare gas and metal halides without modifying the color of said lamp, said method comprising:

initiating an arc discharge within said arc tube with a ballast and imposing an alternating current waveform on said electrodes whereby the electrodes change from positive to negative in each cycle of operation;

establishing a standard for the color rendering index of said lamp;

sensing the color rendering index of the light emission of said lamp over its life;

modifying the waveform of each cycle through the ballast in accordance with said color rendering index sensing whereby to energize one electrode as positive or negative for a longer time than the other electrode thereby altering the temperature distribution within said arc tube by changing the cold spot and hot spot temperatures in said arc tube to result in regaining of said established standard.

12. The method according to claim 11 wherein the wave form for each duty cycle is square.

13. The method according to claim 11 wherein the lamp operates substantially in a direct current mode.

14. A method of changing the deviation from the black body locus ($D_{UV}$) or hue of a high-pressure lamp having an arc tube with electrodes at each end and containing a fill of mercury, rare gas and metal halides without modifying the color temperature of said lamp, said method comprising:

initiating an arc discharge within said arc tube with a ballast and imposing an alternating current waveform on said electrodes whereby the electrodes change from positive to negative in each cycle of operation;

establishing a standard for the deviation from the black body locus ($D_{UV}$) or hue of said lamp;

sensing the deviation from the black body locus ($D_{UV}$) or hue of said lamp;

modifying the waveform of each cycle through the ballast in accordance with said deviation sensing whereby to energize one electrode as positive or negative for a longer time than the other electrode thereby altering the temperature distribution within said arc tube by changing the cold spot and hot spot temperatures in said arc tube to result in regaining of said established standard.

15. The method according to claim 14 wherein the wave form for each duty cycle is square.

16. The method according to claim 14 wherein the lamp operates substantially in a direct current mode.

* * * * *